United States Patent [19]

Livera et al.

[11] Patent Number: 4,781,641

[45] Date of Patent: Nov. 1, 1988

[54] TOOL FOR MAKING THREE-WAY LAMP BASES

[75] Inventors: Phillip A. Livera, Cedar Grove; Paul P. Bracaglia, Fairfield, both of N.J.

[73] Assignee: North American Philips Lighting Corp., New York, N.Y.

[21] Appl. No.: 937,760

[22] Filed: Dec. 4, 1986

[51] Int. Cl.[4] ..... H01J 9/30

[52] U.S. Cl. ..... 445/60; 65/362

[58] Field of Search ..... 445/26, 27, 60; 65/49, 65/362; 439/614, 615; 313/318

[56] References Cited

U.S. PATENT DOCUMENTS 2,975,556 3/1961 Baird ..... 65/43
3,148,305 9/1964 Pearson ..... 313/318 X
3,536,466 10/1970 Kurokawa et al. ..... 65/362 X
4,003,624 1/1977 Smith ..... 439/615 X

FOREIGN PATENT DOCUMENTS 683370 3/1964 Canada ..... 313/318

*Primary Examiner*—Kenneth J. Ramsey
*Attorney, Agent, or Firm*—Robert T. Mayer

[57] ABSTRACT

A tool for making bases for three-way lamps in which it is easier to feed lead wires through because the tool has a first projection in the middle of its base which projection has a round cross-section of a given diameter in the plane perpendicular to the tool's longitudinal axis and a second projection having a cross-section in the forementioned plane having a longer circumferential dimension than a radial one and in which the circumferential dimension is at least as large as the diameter of the first projection in the forementioned plane.

5 Claims, 1 Drawing Sheet

TOOL FOR MAKING THREE-WAY LAMP BASES

This is an invention in the lighting art. More particularly it involves a tool and a method of using the tool to make novel three-way lamp bases.

This application is related to our concurrently filed application entitled "Three Way Lamp Bases and Method for Making Them"assigned to the assignee of this application. That application is incorporated by reference herein.

The standard three-way lamp base has two wires coming out of its bottom. One of these is connected to an eyelet contact which is located at the center of the base. The other wire is off centered and connects to a contact ring which surrounds the eyelet and is insulated from it by glass. The aperture for feeding this off centered wire through the base is itself off centered. Because of this difficulties have been encountered in feeding this wire through its associated aperture.

It is an object of this invention to make it easier to manufacture three-way lamp bases.

One of the features of the invention is the provision of a new tool for use in the manufacture of three-way lamp bases. The new tool is a novel plunger used in forming the glass insulation in the base of three-way lamps.

One of the advantages of the invention is that the new plunger lasts longer than prior art plungers.

In accordance with one aspect of the invention there is provided a round tubular cast metal glass plunger for manufacturing bases for three-way lamps.

Other objects, features and advantages of the invention will be apparent to those skilled in the art from the following description when considered in conjunction with the appended claims and the accompanying drawing in which:

FIG. 1*a* shows the base of a prior art glass plunger used in making three way lamp bases;

FIG. 1*b* is a longitudinal cross-section of the prior art plunger of FIG. 1*a;*

FIG. 2*a* shows the base of the novel plunger of the invention;

FIG. 2*b* is a longitudinal cross-section of the plunger of FIG. 2*a;*

Figure 1A:
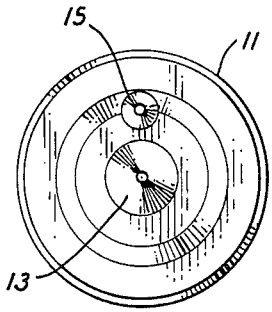
Figure 1B:
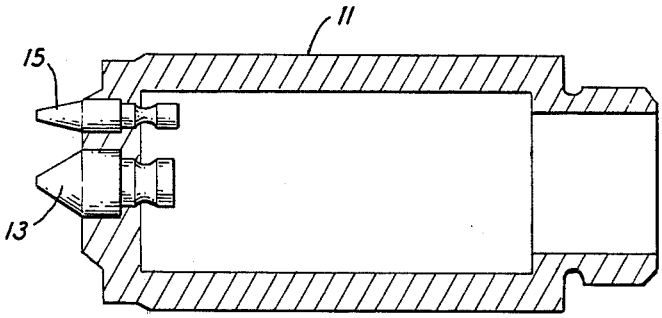

Referring to FIG. 1*a* and 1*b* there is shown a hollow elongated tubular plunger 11. Projecting from the closed end of plunger 11 are plugs 13 and 15. Plunger 11 is hollow in order to allow it to be water cooled in operation. As those skilled in the art understand plunger 11 is used in the manufacture of three-way lamp bases to press into molten glass which has been deposited into a base shell. For this operation, the base shell is held in a prescribed mold with a properly located eyelet and contact ring, as will be explained.

As can be seen from FIG. 1*b* projections 13 and 15 in the past were made of hardened steel plugs fitted into apertures in plunger 11. Because of this the cooling water passing through the interior of plunger 11 was not effective to cool the tips of these projections. As a result these projections softened and wore out rather rapidly.

Figure 2A:
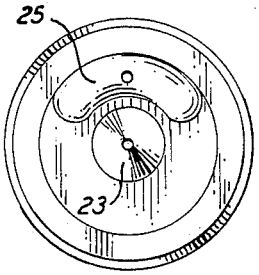
Figure 2B:
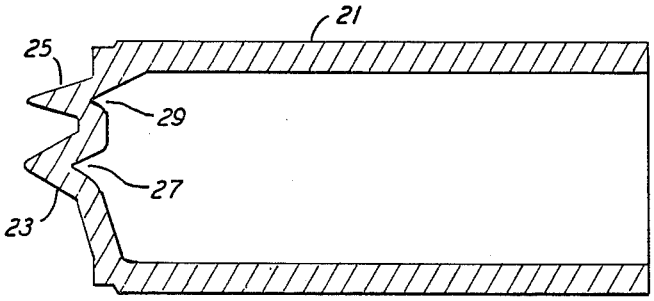

Referring to FIGS. 2*a* and 2*b* there is shown a novel plunger 21. This plunger is made by the lost wax casting process and may be either D2 oil hardenable steel or A2 air hardenable steel. At the present time the latter is preferred. Because this plunger is cast and not machined as prior art plungers were its wall can be made approximately the same prescribed thickness throughout. This is true except at projections 23 and 25. However even at these locations the plunger is internally contoured with dimples 27 and 29 to reduce the thickness of the projections to match more closely the prescribed thickness of the rest of the wall. This aids the cooling of the projections.

Moreover because plunger 21 is cast, off centered projection 25 need not be round. At present it is preferred to make this projection approximately as shown in FIG. 2*a*. The shape of the projection 25 is such that it has a cross-section perpendicular to the longitudinal axis of the plunger which decreases smoothly towards the outward end and has a longer circumferential dimension than a radial one. Projection 23 has a round cross-section as in the prior art.

Figure 3:
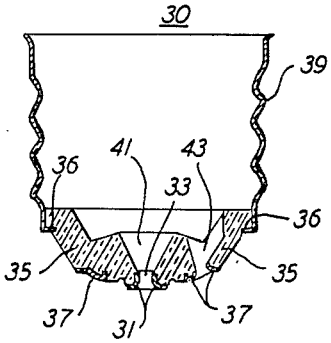
FIG. 3 is a cross-section of a lamp base made in accordance with the invention.
Figure 4:
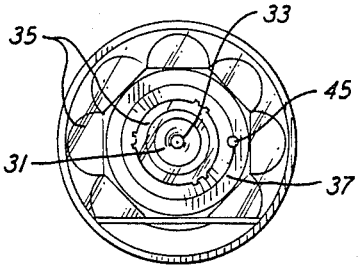
FIG. 4 shows the bottom of the lamp base of FIG. 3.

FIGS. 3 and 4 show lamp base 30 after water cooled plunger 21 has pressed molten glass in a prescribed mold. The glass is hardened in the mold and forms the desired insulation. As can be seen in the center of base 30 is brass eyelet 31 with aperture 33. Surrounding eyelet 31 is glass insulation 35 which separates eyelet 31 from brass contact ring 37. Eyelet 31 is located a predetermined distance below shoulder 36 at the bottom of aluminum shell 39 by glass insulation 35 which surrounds shoulder 36 and extends below it. Contact ring 37 is a fixed distance below shell 39 less than the predetermined distance eyelet 31 is below it.

Projections 23 and 25 when pressed into the molten glass which will become insulation 35 produce recesses 41 and 43. Recesses 41 and 43 are in line with aperture 33 in eyelet 31 and aperture 45 in contact ring 37, respectively. In the manufacturing process these recesses are opened to form apertures in glass 35 in line with apertures 33 and 45. This is done by having slugs of glass which have formed at the bottom of the recesses knocked out by needle like pin plungers.

Apertures 33 and 45 allow contact lead wires to be fed through base 30 in order to contact eyelet 31 and contact ring 37. From plunger 11 (FIGS. 1*a* and 1*b*) it can be appreciated that in the past the off centered recess corresponding to 43 was necessarily smaller than the centered recess corresponding to 41. As a result some difficulty was experienced in directing a lead wire into this off centered recess and through the contact ring aperture.

In the present method, as in the prior art process, plunger 21 is pressed into a gob of a predetermined amount of molten glass deposited inside a threaded tubular shell such as 39 (FIG. 3). The shell is provided with shoulder 36 at one end and held with this shouldered end down and its opposite open end up in a prescribed mold. An eyelet, such as 31, is located in the mold at the center of the shell a predetermined distance below its shoulder. Also held in the mold is a contact ring, such as 37, which surrounds the eyelet and is located a fixed distance below the shouldered bottom of the shell less than the predetermined distance the eyelet is below the shell. When water cooled plunger 21 presses into the molten glass it forces it around the shoulder of the shell and the eyelet, between the eyelet and the contact ring and between the contact ring and the shoulder. Because of the mold and plunger 21, the glass insulation which is formed when the molten glass hardens has the shape shown in FIGS. 3 and 4.

Figure 5:
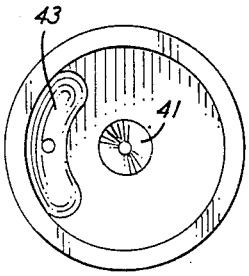
FIG. 5 shows the surface of the glass insulation of a three-way lamp base made in accordance with the invention.

Internally, looking down into shell 39 the insulation's shape is shown in FIG. 5. From this it can be seen that off centered recess 43 in glass insulation 35 has a cross-section perpendicular to the longitudinal axis of shell 39 which has a circumferential dimension which is longer than its radial dimension. By increasing the size of this recess in accordance with the invention it will be apparent that it is easier to feed a lead wire through aperture 45 in contact ring 37.

It is understood that various modifications to the above-described arrangement and method will become evident to those skilled in the art and that the arrangement and method described herein is for illustrative purposes and is not to be considered restrictive.

What is claimed is:

1. A round tubular metal glass plunger for manufacturing bases for three way lamps, said plunger having a longitudinal axis and a base with a first projection in the middle of said base, said first projection having a round cross-section of a given diameter in a predetermined plane perpendicular to the longitudinal axis of said plunger, which plane passes through that half of said first projection closer to said base, said base also having a second projection off centered on it, said second projection having a circumferential dimension about said longitudinal axis in said predetermined plane which is at least as large as the given diameter of said first projection, and which decreases smoothly in the direction away from the base from said predetermined plane to the end of said projection.

2. A round tubular metal glass plunger as claimed in claim 1 wherein said second projection has sloping walls in both the radial and circumferential directions.

3. A round tubular metal glass plunger as in claim 1 having a wall which has approximately the same prescribed thickness throughout except at said projections, said plunger being internally contoured with dimples behind said projections to reduce the thickness of said projections to match more closely the prescribed thickness of said wall.

4. A round tubular metal glass plunger as claimed in claim 1 being of cast metal and wherein said circumferential dimension in said predetermined plane is larger than the given diameter of said first projection.

5. A round tubular cast metal plunger as claim in claim 4 wherein said cross-section of second projection in said predetermined plane has a longer circumferential dimension than a radial one.

* * * * *